US008181373B2

(12) United States Patent
Lopez

(10) Patent No.: US 8,181,373 B2
(45) **Date of Patent: *May 22, 2012**

(54) TENSIONED FABRIC TRADE SHOW DISPLAY

(75) Inventor: Davin E. Lopez, Las Cruces, NM (US)

(73) Assignee: Mesa Digital, LLC, Albuquerque, NM (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/009,069

(22) Filed: Jan. 19, 2011

(65) Prior Publication Data

US 2011/0108219 A1 May 12, 2011

Related U.S. Application Data

(63) Continuation of application No. 11/542,972, filed on Oct. 4, 2006, now Pat. No. 7,918,044.

(60) Provisional application No. 60/724,325, filed on Oct. 5, 2005.

(51) Int. Cl.

| | |
|---|---|
| ***G09F 17/00*** | (2006.01) |
| ***A47G 5/00*** | (2006.01) |
| ***E06B 9/24*** | (2006.01) |
| ***E06B 3/30*** | (2006.01) |

(52) U.S. Cl. ..... 40/603; 160/377

(58) Field of Classification Search ..... 40/603; 160/377

See application file for complete search history.

(56) References Cited

U.S. PATENT DOCUMENTS

| | | | | |
|---|---|---|---|---|
| 4,785,565 | A | 11/1988 | Kuffner | |
| 5,259,669 | A | 11/1993 | Leach et al. | |
| 5,537,766 | A | 7/1996 | Nickens et al. | |
| 5,584,566 | A | 12/1996 | Bowman et al. | |
| 5,645,096 | A | 7/1997 | Hazinski et al. | |
| 5,826,397 | A | 10/1998 | Armold | |
| 5,946,874 | A | 9/1999 | Roberts | |
| 5,975,101 | A * | 11/1999 | Zheng | 135/125 |
| 6,149,021 | A | 11/2000 | Beaulieu | |
| 6,257,263 | B1 | 7/2001 | Brereton | |
| 6,502,596 | B1 | 1/2003 | Danaher | |
| 6,714,407 | B2 * | 3/2004 | Zheng | 361/679.02 |
| 6,854,204 | B2 | 2/2005 | Uden | |
| 2002/0092626 | A1 | 7/2002 | Beall | |
| 2002/0108542 | A1 | 8/2002 | Wilton | |
| 2002/0154942 | A1 | 10/2002 | Boer | |
| 2003/0047292 | A1 | 3/2003 | Fritsche et al. | |
| 2003/0047294 | A1 | 3/2003 | Fritsche et al. | |
| 2003/0101629 | A1 | 6/2003 | Lingamfelter et al. | |
| 2003/0183134 | A1 | 10/2003 | Jackson | |

(Continued)

OTHER PUBLICATIONS

Closing the Cage Mouth Net into Four Circles, 2002, IZZO Golf Inc.

*Primary Examiner* — Joanne Silbermann
*Assistant Examiner* — Syed A Islam
(74) *Attorney, Agent, or Firm* — Kermit D. Lopez; Luis M. Ortiz; Ortiz & Lopez, PLLC

(57) ABSTRACT

A "pop up" portable display apparatus includes a flexible frame and a tensioned fabric having a perimeter hem, such that the tensioned fabric is maintained by the flexible frame and integrated with the perimeter hem in order for the tensioned fabric to expand with the flexible frame to produce a display area and reduce with the flexible frame for ease of transport.

20 Claims, 6 Drawing Sheets

U.S. PATENT DOCUMENTS

2003/0205546 A1 11/2003 Fritsche et al.
2004/0000117 A1 1/2004 Schipani et al.
2004/0000620 A1 1/2004 Schipani et al.
2004/0111999 A1 6/2004 Schipani et al.
2004/0160457 A1 8/2004 Termotto
2004/0163778 A1 8/2004 Fritsche et al.
2004/0232298 A1 11/2004 Bremmon et al.
2004/0237367 A1* 12/2004 Ali ..... 40/633
2005/0017137 A1 1/2005 Burris
2005/0039412 A1 2/2005 Fritsche et al.
2005/0055938 A1 3/2005 Secondino
2005/0055946 A1 3/2005 Schipani et al.

* cited by examiner

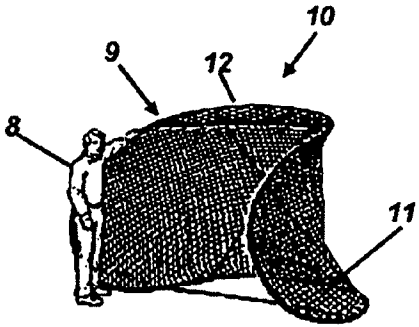
FIG. 1
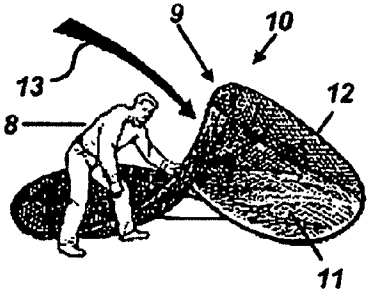
FIG. 2
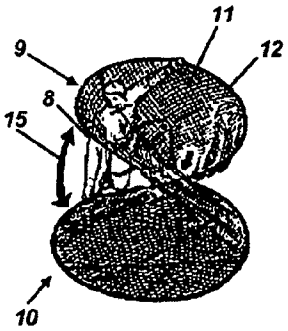
FIG. 3
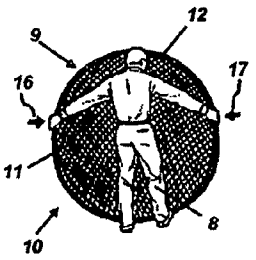
FIG. 4
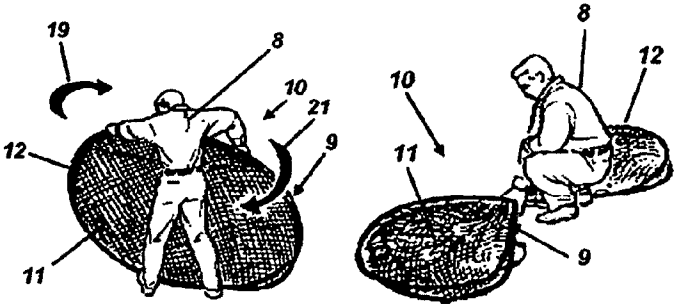
FIG. 5
FIG. 6
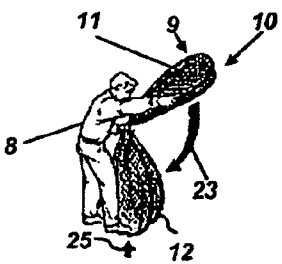
FIG. 7
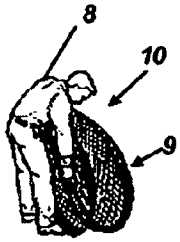
FIG. 8
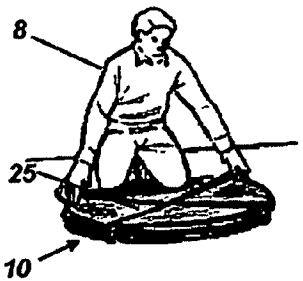
FIG. 9

TENSIONED FABRIC TRADE SHOW DISPLAY

CROSS-REFERENCE TO PATENT APPLICATION

This patent application is a continuation of U.S. patent application Ser. No. 11/542,972 filed on Oct. 4, 2006 now U.S. Pat. No. 7,918,044 and entitled "Tensioned Fabric Trade Show Display," which is incorporated herein by reference in its entirety. U.S. patent application Ser. No. 11/542,972 claims the benefit of provisional patent application Ser. No. 60/724,325, entitled "Tensioned Fabric Trade Show Display" which was filed on Oct. 5, 2005, the disclosure of which is also incorporated herein by reference in its entirety.

TECHNICAL FIELD

Embodiments are generally related to trade show displays. Embodiments are also related to collapsible self-supporting trade show, or convention backdrops and displays. Embodiments are additionally related to portable trade show displays and presentation devices.

BACKGROUND OF THE INVENTION

In the field of trade show conventions, spaces are typically allocated with minimal frontages. Most commercially available backdrops or display devices are produced with either eight or ten foot increments. Moreover, these backdrops typically have limited configurations to which the vendor may adapt his display. Most commercially available backdrops are limited to one particular shape and size. The vendor often must purchase multiple backdrops of varying shapes and sizes such that are properly suited for various convention or trade show locations.

Trade shows provide an ideal venue for participants to display their goods and services to others in the industry, potential customers, and members of the general public. At any given time, there are literally tens of hundreds of trade shows going on around the country and world. The business of providing and setting up the various trade show display structures and equipment has, in its own right, created many new business opportunities. However, the high costs associated with purchasing, maintaining, transporting, storing, and setting up and taking down trade show display structures are an ongoing source of concern. Those in the industry of manufacturing trade show display structures are continually searching for new ways to improve their trade show display structures to make them less expensive to manufacture and maintain, more compact to store and ship,lighter in weight, and quicker and easier to set up and take down.

One popular style of display structure utilizes numerous modular panel sections which can be quickly and easily joined together into a number of customizable structures to suit the end-user's needs, and when not used, broken down for compact and lightweight storage and shipping. The modular panel sections have a frame structure assembled from rail sections, with openings formed between the rails. The openings are typically occupied by opaque, transparent or translucent panels, depending on how the panels will be used. In some of these systems, spot lights are placed in front of the trade show display structures and are used to illuminate the graphics and images on the panels.

One of the problems with conventional trade show display devices and systems is that such products are often transported from trade show to trade show, permitting users of the display devices to advertise their goods and services. Users must carry their display devices, which are typically very heavy, bulky and awkward, from place to place and set up and tear down their displays frequently. Often, users are forced to ship their display devices and systems using delivery services and pay for the associated transportation and delivery expenses, which can be quite costly. Different trade show locations, such as, for example, convention centers, may offer different limitations on available floor space and best viewing angle. Consequently, users desire lightweight easy-to-assemble, adjustable, and inexpensive display stands.

Another problem associated with the use of conventional trade show display devices and systems is that in most cases, a user is often not even permitted to move and set-up a display at a trade show due to restrictions and liability issues. For example, in most convention centers, only union employees of the trade show center or convention hall are allowed to move the display to the display space unless the display can be carried by a single person.

Accordingly, what is needed to overcome these problems is a collapsible and easily transportable display stand that is inexpensive to construct, has adjustable features and is in fact truly portable and can be placed in a stable configuration and on an uneven surface. Additionally, unlike many trade show devices, which claim to be "pop up" trade show displays, a true "pop up" feature is desired, which can be opened and/or reduced with little tools and external components.

BRIEF SUMMARY

The following summary of the invention is provided to facilitate an understanding of some of the innovative features unique to the present invention and is not intended to be a full description. A full appreciation of the various aspects of the invention can be gained by taking the entire specification, claims, drawings and abstract as a whole.

It is therefore one aspect of the present invention to provide for an improved trade show display apparatus.

It is another aspect of the present invention to provide for a portable and collapsible self-supporting trade or convention backdrop or display apparatus.

It is a further aspect of the present invention to provide for a portable and pop-up trade show display apparatus.

It is yet a further aspect of the present invention to provide for a trade show display apparatus that can be screen printed with display information, media, graphics and the like.

The above and other aspects of the invention can be achieved as will now be briefly described. A portable display apparatus is disclosed, which includes a flexible frame and a tensioned fabric having a perimeter hem, such that the tensioned fabric is maintained by the flexible frame and integrated with the perimeter hem in order for the tensioned fabric to expand with the flexible frame to produce a display area and reduce with the flexible frame for ease of transport. The tensioned fabric can be formed from a sheet of substantially non-stretchable, flexible fabric material, which can be screen-printable for screen printing display information. Alternatively, the tensioned fabric can be formed from or incorporate some form attachable material such as Velcro.

In accordance with an alternative embodiment, one or more connectable slits can be formed in the tension fabric in order to maintain display items by the concealable slit or as a pass through for additional hardware such as, for example, audio-visual equipment and stands with hardware and wiring capable of being fed from the rear of the display apparatus through a concealable slit.

In another embodiment, a plurality of pockets can be formed from a rear side of the tensioned fabric for maintaining a plurality of magnets which enable magnetic attachment and support to a plurality of respective metallic objects associated with display material viewable on a front side of the tensioned fabric, and for optional direct attachment or storage of display media thereof. Where magnets are used in the pockets, the magnets are thereby capable of suspending display media on the front side of the tensioned fabric when the portable display apparatus is deployed in a display configuration.

The substantially non-stretchable, flexible fabric material can be disposed in a generally upright orientation when the flexible frame is deployed. The flexible frame is capable of being twisted into a flat coil of reduced diameter for storage and transport. Similarly, the flexible frame and the tensioned fabric are capable of being twisted together into a flat coil of reduced diameter for storage and transport. Additionally, the flexible frame can comprise a flexible, resilient strip material such as, for example, one of the following: spring steel, plastic or a combination thereof.

BRIEF DESCRIPTION OF THE DRAWINGS

The accompanying figures, in which like reference numerals refer to identical or functionally similar elements throughout the separate views and which are incorporated in and form part of the specification, further illustrate embodiments of the present invention.

FIG. 1 illustrates a first step in a process for reducing a trade show display apparatus, in accordance with an embodiment;

FIG. 2 illustrates a second step in a process for reducing a trade show display apparatus, in accordance with an embodiment;

FIG. 3 illustrates a third step in a process for reducing a trade show display apparatus, in accordance with an embodiment;

FIG. 4 illustrates a fourth step in a process for reducing a trade show display apparatus, in accordance with an embodiment;

FIG. 5 illustrates a fifth step in a process for educing a trade show display apparatus, in accordance with an embodiment;

FIG. 6 illustrates a sixth step in a process for reducing a trade show display apparatus, in accordance with an embodiment;

FIG. 7 illustrates a seventh step in a process for reducing a trade show display apparatus, in accordance with an embodiment;

FIG. 8 illustrates an eighth step in a process for reducing a trade show display apparatus, in accordance with an embodiment;

FIG. 9 illustrates a ninth step in a process for reducing a trade show display apparatus, in accordance with an embodiment;

DETAILED DESCRIPTION OF THE INVENTION

Figure 10:
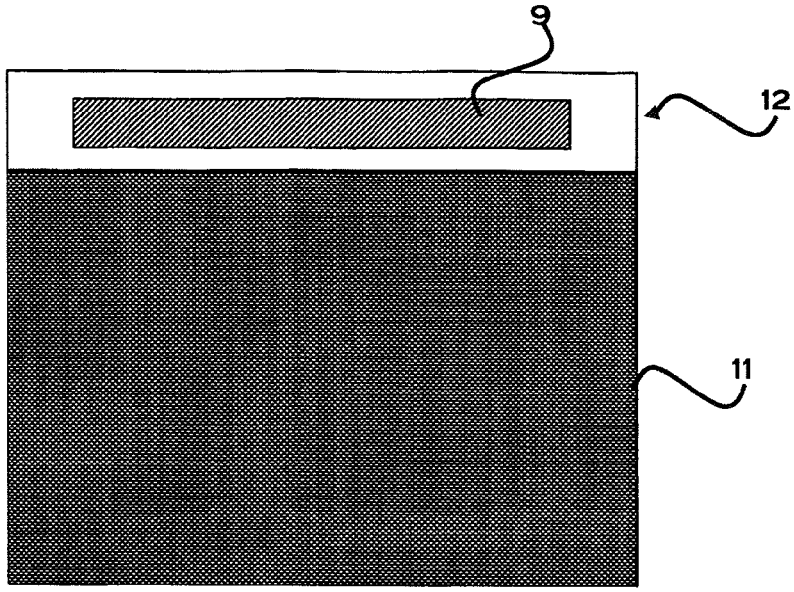
FIG. 10 illustrates a sectional view of the tensioned fabric and flexible frame depicted in FIGS. 1-9, in accordance with an embodiment.

The particular values and configurations discussed in these non-limiting examples can be varied and are cited merely to illustrate embodiments of the present invention and are not intended to limit the scope thereof.

FIG. 1 illustrates a portable display apparatus 10, which can be implemented in accordance with one embodiment. In general, the portable display apparatus 10 is composed of a flexible frame 9 and a tensioned fabric 11, which includes a perimeter hem 12. The tensioned fabric 11 is maintained by the flexible frame 9 and integrated with the perimeter hem 12 in order for the tensioned fabric 11 to expand with the flexible frame 9 to produce a display area and reduce with the flexible frame 9 for ease of transport. The flexible frame 9 can be comprise, for example, a flexible, resilient strip material such as, but not limited to one of the following types of material: spring steel, plastic or a combination thereof.

The tensioned fabric 11 can be formed from a sheet of substantially non-stretchable, flexible fabric material. Such a sheet of substantially non-stretchable, flexible fabric material is disposed in a generally upright orientation when the flexible frame 9 is fully deployed as indicated in FIG. 1. In general, the tensioned fabric 11 can be screen-printable for screen printing display information, such as, for example, advertising and trade show information. Tensioned fabric 11 may also be formed from or incorporate some form of attachable fabric such as Velcro. Note that "Velcro" is essentially a brand name of fabric hook-and-loop fasteners used for connecting objects.

FIG. 1 also illustrates a first step in a process for reducing a portable display apparatus 10, in accordance with an embodiment. In the first step depicted in FIG. 1, a user 8 can position him in front of the portable display apparatus 10. The user can then stand to the left of the portable display apparatus 10, and grab the left side of the portable display apparatus 10, with his or her left hand. Note that in FIGS. 1-9, identical or similar parts or elements are generally indicated by identical reference numerals.

FIG. 2 illustrates a second step in a process for reducing the trade show display apparatus 10, in accordance with an embodiment. In the second step indicated in FIG. 2, a user can push down across his or her body until the portable display apparatus 10 is flat on the ground. Arrow 13 generally indicates the direction of movement associated with the portable display apparatus 10.

FIG. 3 illustrates a third step in a process for reducing the trade show display apparatus 10, in accordance with an embodiment. As indicated in FIG. 3, the user 8 can step approximately in the middle of the "figure eight" configuration formed by the portable display apparatus 10 and pull up on one side of the "figure eight" to meet the other, thereby forming two circles. The circles can be adjusted until they are approximately the same size. Arrow 15 generally indicates the foregoing movement.

FIG. 4 illustrates a fourth step in a process for reducing the trade show display apparatus 10, in accordance with an embodiment. As indicated in FIG. 4, the user 8 can place his or her foot on the bottom of the two circles formed from the portable display apparatus 10 and lift the tensioned fabric 11 up vertically. The user 8 can then use his or her left and right hands so that they are at the two and ten o'clock positions on the circle. Note that arrows 16 and 17 respectively indicate how user 8 can position his left and right hands in order to continue the process of reducing the trade show display apparatus 10.

FIG. 5 illustrates a fifth step in a process for reducing the trade show display apparatus 10, in accordance with an embodiment. As indicated in FIG. 5, the user 8 can push hard downward towards the ground with both hands. Arrows 19 and 21 generally indicate how the user 8 continues to reduce the trade show display apparatus 10. The tensioned fabric 11 together with the flexible frame 9 can then collapse down to the user's approximate waste height. The user 8 can then pause momentarily and then push forward and down with his right hand as he pulls his left hand simultaneously toward his body as indicated by arrows 19 and 21. The trade show display apparatus 10 then continues to collapse toward the ground.

FIG. 6 illustrates a sixth step in a process for reducing the trade show display apparatus 10, in accordance with an embodiment. The pushing and twisting motion depicted in FIG. 5 can result in an even smaller "figure eight" formation for the trade show display apparatus 10 than that illustrated previously in FIG. 2. This smaller "figure eight" configuration is depicted in FIG. 6. At this point, the trade show display apparatus 10 is preferably flat on the ground and the user 8 can grab the trade show display apparatus 10 tightly and firmly with both hands.

FIGS. 7-8 illustrate respective seventh and eighth step sin a process for reducing the trade show display apparatus 10, in accordance with an embodiment. As indicated in FIG. 7-8, the trade show display apparatus 10 can be lifted horizontally by the user 8 from the ground and then tilted vertically as indicated by arrow 21. The user can then place his or her foot on the bottom of the "figure eight" as indicated by arrow 25 and can then lean the trade show display apparatus 10 against his or her thigh. The user then can position his or her left foot forward from his or her respective right foot and the grab the top of the "figure eight" with his or her right hand and push forward and down very firmly as indicated in FIG. 8. Such an action may require some exertion. The user 8 can then hold the center of the trade show display apparatus 10 firmly with his or her left hand.

FIG. 9 illustrates a ninth step in a process for reducing a trade show display apparatus 10, in accordance with an embodiment. As indicate generally in FIG. 9, the user 8 can hold the four resulting circles tight together and then carefully lay the reduced trade show display apparatus 10 on the ground. The user 8 should not let go of the portable display apparatus 10, because from the position depicted in FIG. 9, the trade show display apparatus 10 may pop open again. Instead, the user 8 should maintain his feet or knees on the flexible frame 9 and slide a storage strap 25 over the reduced portable trades show display apparatus 10.

The user 8 should preferably make certain that the strap 25 is centered on the folded trade show display apparatus 10 in order to ensure that the strap 25 properly fits over and maintains the trade show display apparatus for subsequent storage and transportation. When the portable display apparatus 10 is reduced to its collapsible state as indicated in FIG. 9, the trade show display apparatus 10 can then be transported easily by user 8 through, for example, air transportation, automobiles, etc., without taking up much room or space.

From FIGS. 1-9, it can be appreciated that the tensioned fabric 11 is formed from a sheet of substantially non-stretchable., flexible fabric material. Such a sheet can be disposed in a generally upright orientation when the flexible frame 9 is fully deployed as shown, for example in FIG. 1. The flexible frame 9 is thus capable of being twisted into a flat coil of reduced diameter for storage and transport as indicated through the process depicted in FIGS. 1-9. Such a process also indicates the flexible frame 9 and the tensioned fabric 11 are capable of being twisted together into a flat coil of reduced diameter for storage and transport. As indicated in FIGS. 7-9, for example the portable display apparatus 10 is reduced into a coil configuration.

Figure 11:
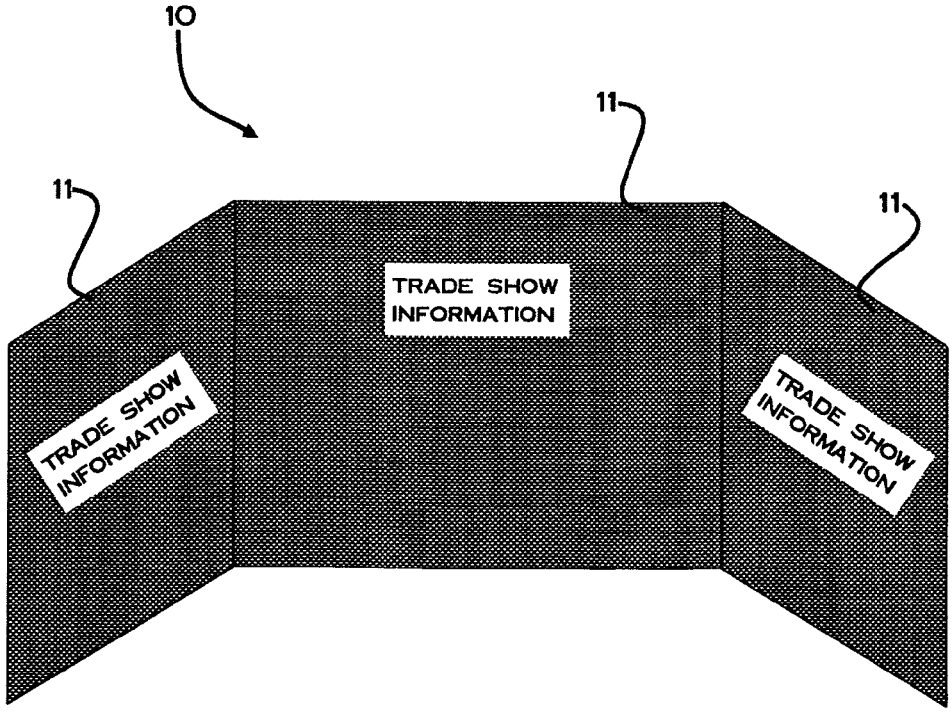
FIG. 11 illustrates an expanded but alternative view of the portable display apparatus depicted in FIG. 1-9 in accordance with an alternative embodiment.

FIG. 10 illustrates a sectional view of the tensioned fabric 11 and flexible frame 9 depicted in FIGS. 1-9, in accordance with an embodiment. Note that in FIGS. 1-13 identical parts or elements are generally indicated by identical reference numerals. Thus, the configuration illustrated in FIG. 10 is presented in order to show in greater detail the fact that the tensioned fabric 11 is configured to include a perimeter hem 12 in which the flexible frame 9 is maintained and integrated with the perimeter hem 12 in order for the tensioned fabric 11 to expand with the flexible frame 9 to produce a display area thereof and reduce with the flexible frame 9 and portable trade show apparatus 10 thereof for ease of transport FIG. 11 illustrates an expanded but alternative view of the portable display apparatus 10 depicted in FIG. 1-9 in accordance with an alternative embodiment. As indicated in FIG. 11, the portable display apparatus 10 can be provided with a generally rectangular shape. It can be appreciated, however, that many other shapes are possible for display apparatus 10, such as substantially oval, circular, square, triangular and so forth. The rectangular shape of the portable display apparatus 10 depicted in FIG. 11 is provided for illustrative purposes only and is not considered a limiting feature of the embodiments.

Figure 12:
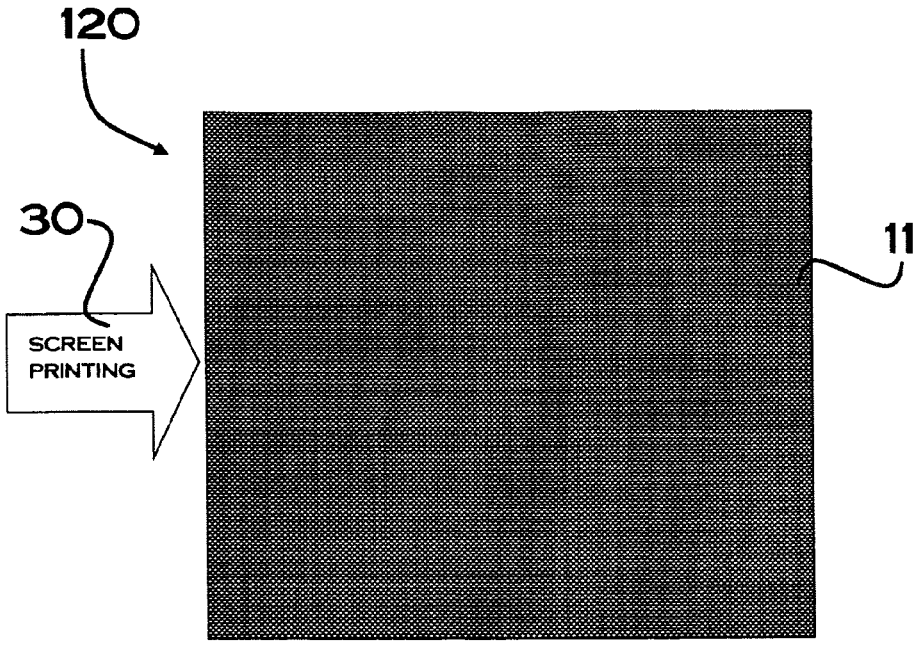
FIG. 12 illustrates a process for screen printing information on the tensioned fabric depicted in FIGS. 1-11, in accordance with an alternative embodiment.

FIG. 12 illustrates a process 120 for screen printing information on the tensioned fabric depicted in FIGS. 1-11 in accordance with an alternative embodiment. In general, screen printing is depicted in FIG. 12 by arrow 30. Information can be screen printed on tensioned fabric 11 for eventual display via portable display apparatus 10. Screen printing, as represented by arrow 30, is generally implemented as a printing technique involving the passage of printing medium, such as ink, through a web or fabric, which has been stretched on a frame, to which a refined form of stencil has been applied. Stencil openings can determine the form and dimensions of the imprint thus produced. Screen printing, as indicated by arrow 30, can also be implemented as a form of porous printing. The process by which the image area is created by forcing ink through a "screen" or mesh, created by blocking off all areas in the "screen" where no image is to be formed; an example would be silk screen printing of cloth or other material. Mimeograph printing is also another form of porous (screen) printing and can be utilized to implementing the printing type depicted in FIG. 12 by arrow 30. It can be appreciated that other types of display information, media, or trade show graphics can be displayed via the portable display apparatus 10 in lieu of screen printing.

Figure 13:
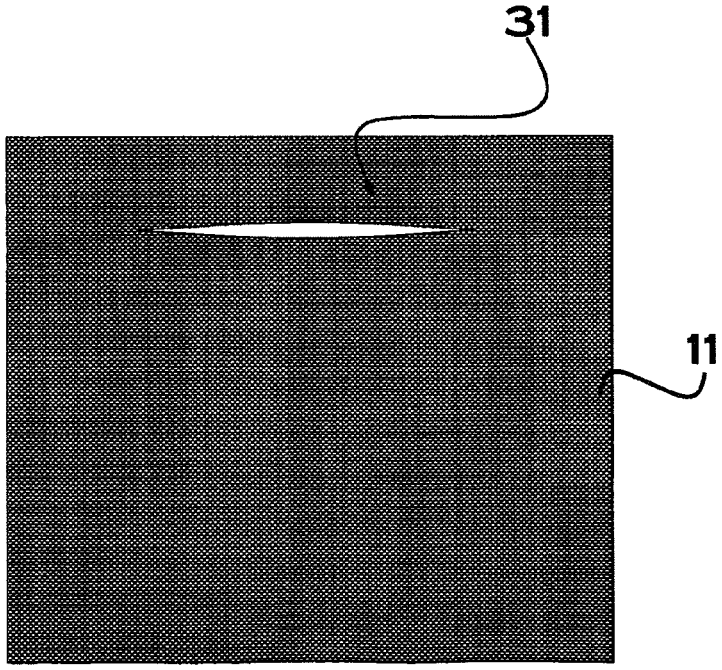
FIG. 13 illustrates a concealable slit that can be formed from the tensioned fabric depicted in FIGS. 1-12, in accordance with an alternative embodiment.

FIG. 13 illustrates a concealable slit 31 that can be formed in the tensioned fabric 11 depicted in FIGS. 1-12, in accordance with an alternative embodiment. Thus, tensioned fabric 11 can modified to include one or severable concealable slit 31 for incorporation into the portable display apparatus 10. Display items and or other informational display material can be maintained by or from concealable slit 31 depending upon design considerations. For example, portable electronic displays or television monitors can be supported with hardware through the concealable slit 31, depending upon the goals of the user of the display apparatus 10.

Information pamphlets and/or other display information can be maintained (e.g., hung from) concealable slit 31 when the display apparatus 10 is in an open position for trade show display activities, such as in the configuration depicted in FIG. 1. In general concealable slit 31 can be formed from the tension fabric 11 in order to maintain display items by the concealable slit 31 or as a pass through for additional hardware such as, for example, audio-visual equipment stands, display retaining stands and hardware, and electrical wiring for power and data, all capable of being fed from the rear of the display apparatus through the concealable slit(s) 31.

Figure 14:
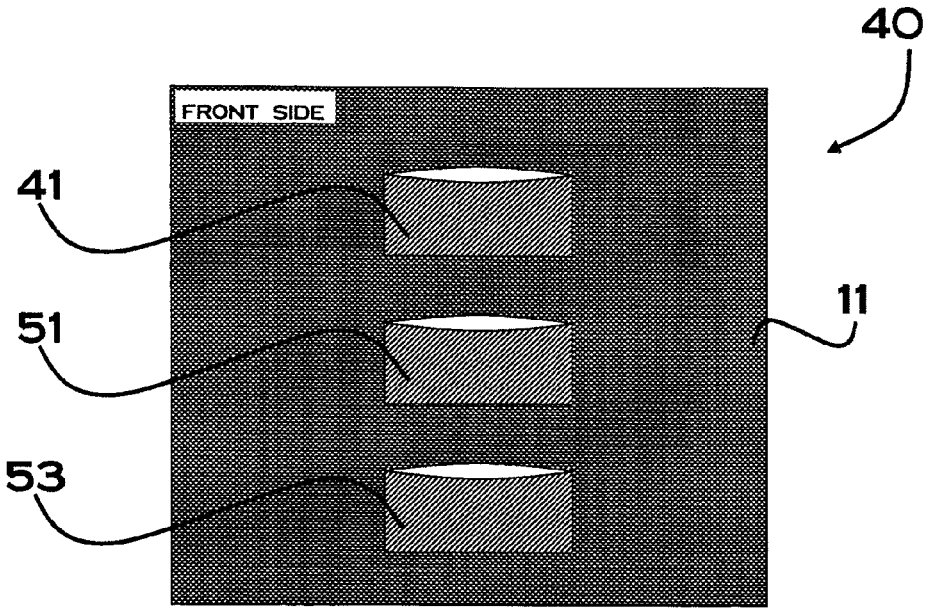
FIG. 14 illustrates a group 40 of pockets integrated into or onto fabric that can be formed from the tensioned fabric depicted in FIGS. 1-13 in accordance with an alternative embodiment.
Figure 15:
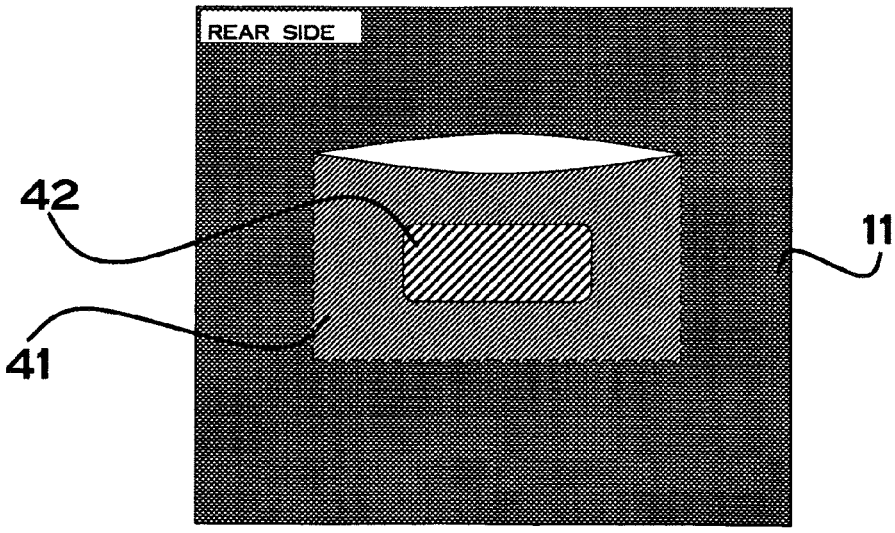
FIG. 15 illustrates pockets integrated into or onto fabric and supporting a magnet that can be formed from the tensioned fabric depicted in FIGS. 1-14 in accordance with an alternative embodiment.
Figure 16:
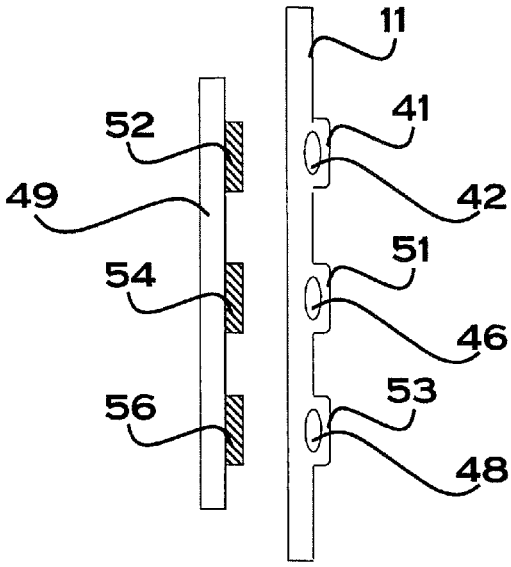
FIG. 16 illustrates a side cutaway view of a display fabric including pockets carrying magnets that are adapted to support a sign having a metal material thereon.

FIGS. 14-16 illustrate a group 40 of pockets 41, 51, 53 integrated into or onto the tensioned fabric 11, in accordance with an alternative embodiment. The front side or display side of tensioned fabric 11 is shown in FIG. 14. FIG. 15 shows a rear side or non-display side of tensioned fabric 11 and a single pocket 41, which is also depicted in FIG. 14. A magnet 42 maintained within pocket 41. FIG. 15 depicts a side view of tensioned fabric 11 when exposed in a deployable configuration of the trade show display apparatus 10. In FIG. 15, pockets 41, 51, and 53 are shown holding respective magnets 42, 46, and 48, which hold/secure through the fabric metallic objects 52, 54 and 56, which in turn are attached or connected to a display poster 49 for attachment to the front or display side of tensioned fabric 11 when the display apparatus 10 is located in a deployed position.

When the group 40 of pockets 41, 51, 53 are deployed about the front or display side of the tensioned fabric 11, the pockets 40 can be utilized to hold advertising material (e.g., brochures or trade show graphics). When the group 40 of pockets 41, 51, 53 are integrated about the rear or non-display of the tensioned fabric 11, the group 40 of pockets 41, 51, 53 can be utilized to hold one or more magnets 42, 46, 58 as depicted in FIG. 16, which can interact with metallic objects 52, 54 and 56 on the front or display side of the display apparatus 10, thereby providing flexibility as to the display of suspended graphical material not attached to tensioned fabric 11 or screen printed thereof. For example, the metallic objects can be implemented as a thin metallic strip attached to the rear of display poster 49 and then suspended in free space in front of the tensioned fabric 11 due to the presence of magnets 42, 46, and 48 in respective rear panel pocket 41, 51, and 53 thereof.

Figure 17:
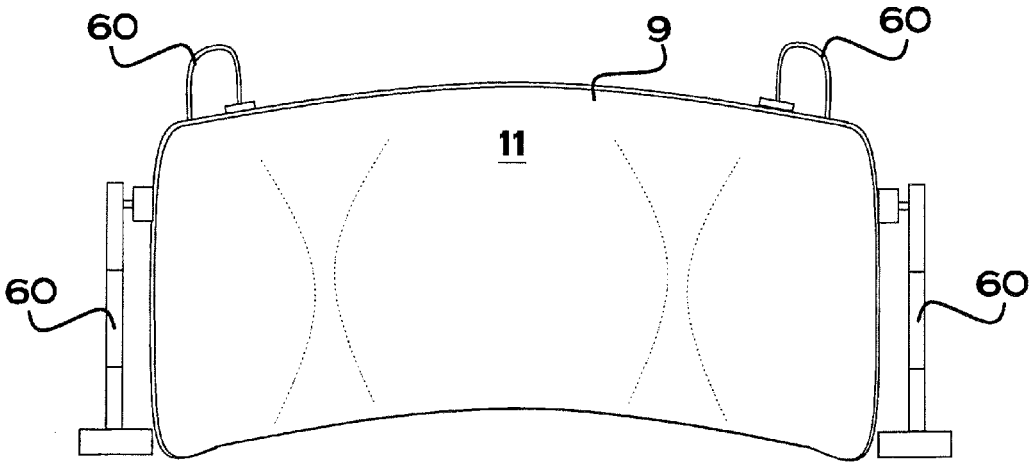
FIG. 17 illustrates a supplemental support system usable with the portable display depicted in FIGS. 1-16.

An additional embodiment provides for a supplemental support system to be used with the portable display where additional support is required. Referring to FIG. 17, for example, the fabric 11 and flexible frame 9 are shown fully deployed. Supplemental supports 60 are also depicted as attached at various points along the flexible frame 9. It should be appreciated that the supplemental supports 60 can hold the portable display apparatus 10 in place and assist in its upright suspension as needed. For example, in outdoor applications the portable display apparatus 10 can be supported in steady position and held to the ground should a gust of wind blow through the outdoor tradeshow venue. The support system should possess adequate weight to provide ballast for maintaining the display in place with moderate breezes or other physical disturbance. The supplemental support system can be made of metallic, plastic or wood materials similar to freestanding posts utilized for temporary line formations, for example at entertainment venues and airports.

With respect to fabric material suitable for use with the described portable display apparatus 10, it is preferred that the material be rip-resistant and durable enough to withstand outward tension created by the frame 9 along the perimeter hem 12. One type of fabric, for example, that can be suitable for use as tensioned fabric 11 is parachute fabrics. Some products from the parachute industry are also suitable for balloon envelopes, which proves their durability for the trade show display application taught herein. 1.1 oz. calendared rip-stop Nylon and 1.3 oz. calendared, silicone-coated, rip-stop Nylon are materials available from parachute manufacturers and their suppliers. Parachute fabrics may not have the same resistance to high temperatures as special balloon fabrics, Other materials with rip-stop, lightweight properties can be considered for the fabric so long as it can support media such as that applied through screen printing processes. Such material thus can be suitable for implementing tensioned fabric 11, depending upon design considerations. It is understood, however, tensioned fabric 11, can be formed from other material.

A number of potential applications for portable display apparatus 10 can be implemented. For example, the portable display apparatus 10 can be utilized for trade shows and may be sized, for example, in 10×10 feet or 10×8 feet configurations. Another area where the portable display apparatus 10 will find usefulness is the area of table top displays, such as, for example, grade school and high school science fairs and general presentations or meetings. In such scenarios, the portable display apparatus 10 would likely be sized smaller than those utilized in trade shows.

The graphics for the portable display apparatus 10 may be provided directly by the user or as indicated previously, may be screen printed onto the portable display apparatus 10 by a graphics provider, depending upon the type of and goals of the portable display apparatus 10 desired by the user. The portable display apparatus 10 may also be rented by a trade show rental agency or purchased directly from an office supply store (e.g., Office Depot, Office Max, Staples, etc.) or through an Internet distributor.

Figure 18:
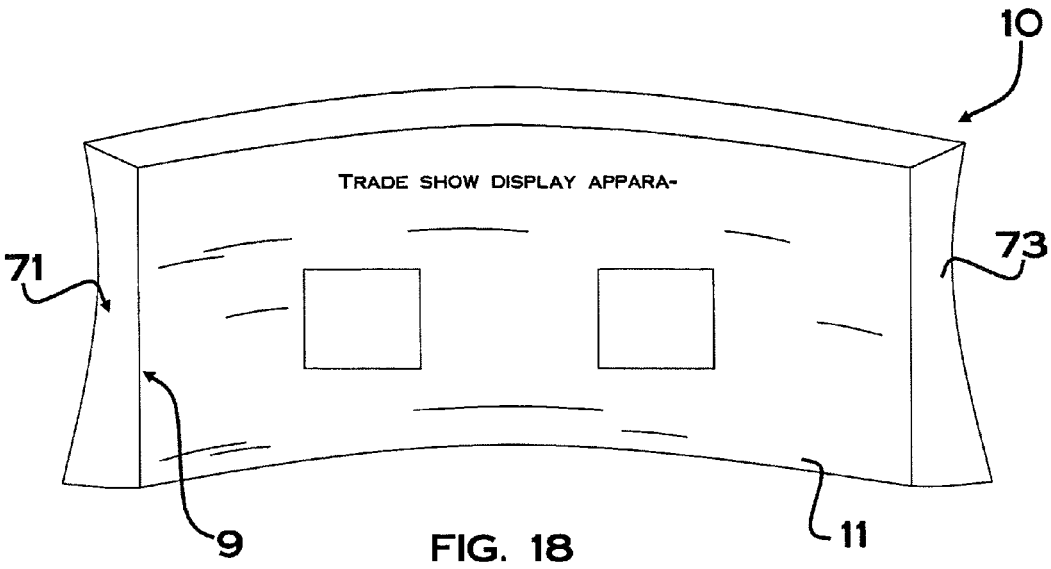
FIGS. 18 and 19 respectively illustrate front and side pictorial representations of a portable display apparatus, in accordance with an alternative embodiment.
Figure 19:
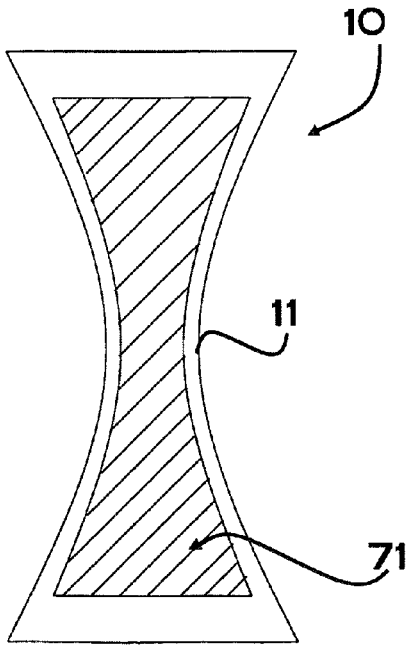

FIGS. 18 and 19 respectively illustrate front and side pictorial representations of the portable display apparatus 10, in accordance with an alternative embodiment. FIGS. 18-19 are presented herein in order to illustrate alternative shapes or configurations for the portable display apparatus 10. Note that in FIGS. 18-19 identical or similar parts or elements are generally indicated by identical reference numerals. The flexible frame 9 depicted in FIGS. 18-19 is generally surrounded by the tensioned fabric 11. In FIG. 18 a left hand side 71 is also depicted along with a right side 73 of the portable display apparatus 10. Only the left hand side 71 is shown in FIG. 19. The configuration of the apparatus 10 has a different shape than that depicted earlier, thus indicating that the apparatus 10 may be implemented in variety of shapes and sizes.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A portable trade show display apparatus, comprising:

a flexible frame; and a tensioned fabric having a perimeter hem, said tensioned fabric comprising a sheet of substantially non-stretchable, flexible fabric material; and at least one concealable slit formed from said tensioned fabric, wherein said tensioned fabric is maintained by said flexible frame and integrated with said perimeter hem in order for said tensioned fabric to expand with said flexible frame to produce a display area and reduce with said flexible frame for ease of transport, wherein said flexible frame and said tensioned fabric provide a portable display apparatus for use in a trade show, wherein said portable display apparatus is collapsible and self-supporting.

2. The portable trade show display apparatus of claim 1 wherein said sheet of substantially non-stretchable, flexible fabric material is disposed in a generally upright orientation when said flexible frame is fully deployed on a floor or platform in said trade show.

3. The portable trade show display apparatus of claim 1 wherein said flexible frame is capable of being twisted into a flat coil of reduced diameter for storage and transport to said trade show.

4. The portable trade show display apparatus of claim 1 wherein said flexible frame and said tensioned fabric are capable of being twisted together into a flat coil of reduced diameter for storage and transport to said trade show.

5. The portable trade show display apparatus of claim 1 wherein said flexible frame comprises flexible, resilient strip material including at least one of the following: spring steel, plastic or a combination thereof.

6. The portable trade show display apparatus of claim 1 wherein said tensioned fabric is screen-printable for screen-printing display information.

7. The portable trade show display apparatus of claim 1 wherein said display area displays advertising media.

8. The apparatus of claim 1 wherein a plurality of pockets are formed in at least one of a rear or front side of said tensioned fabric for maintaining a plurality of respective magnets which magnetically attached to a plurality of respective metallic objects on a front side of said tensioned fabric for attachment to display media thereof, thereby suspending said display media on said front side of said tensioned fabric when said portable display apparatus is deployed in a display configuration.

9. The portable trade show display apparatus of claim 1 wherein said and wherein said flexible frame and said tensioned fabric are capable of being twisted together into a flat coil of reduced diameter for storage and transport to said trade show.

10. The portable trade show display apparatus of claim 9 wherein said flexible frame comprises flexible, resilient strip material including at least one of the following: spring steel, plastic or a combination thereof.

11. The portable trade show display apparatus of claim 9 wherein said tensioned fabric is screen-printable for screen-printing display information.

12. A portable trade show display apparatus, comprising:

a flexible frame; and a tensioned fabric having a perimeter hem, said tensioned fabric comprising a sheet of substantially non-stretchable, flexible material, such that said tensioned fabric is maintained by said flexible frame and integrated with said perimeter hem in order for said tensioned fabric to expand with said flexible frame to produce a display area and reduce with said flexible frame for ease of transport, wherein said flexible frame and said tensioned fabric provide a portable display apparatus for use in a trade show, wherein said portable display apparatus is collapsible and self-supporting, wherein said sheet of substantially non-stretchable, flexible fabric material is disposed in a generally upright orientation when said flexible frame is fully deployed on a floor or platform in said trade show.

13. The portable trade show display apparatus of claim 12 wherein at least one concealable slit is formed from said tensioned fabric.

14. The portable trade show display apparatus of claim 13 wherein said flexible frame is capable of being twisted into a flat coil of reduced diameter for storage and transport to said trade show.

15. The portable trade show display apparatus of claim 13 wherein said flexible frame and said tensioned fabric are capable of being twisted together into a flat coil of reduced diameter for storage and transport to said trade show.

16. The portable trade show display apparatus of claim 13 wherein said flexible frame comprises flexible, resilient strip material including at least one of the following: spring steel, plastic or a combination thereof.

17. The portable trade show display apparatus of claim 13 wherein said tensioned fabric is screen-printable for screen-printing display information.

18. The portable trade show display apparatus of claim 13 wherein said display area displays advertising media.

19. The portable trade show display apparatus of claim 13 wherein a plurality of pockets are formed in at least one of a rear or front side of said tensioned fabric for maintaining a plurality of respective magnets which magnetically attached to a plurality of respective metallic objects on a front side of said tensioned fabric for attachment to display media thereof, thereby suspending said display media on said front side of said tensioned fabric when said portable display apparatus is deployed in a display configuration.

20. A portable trade show display apparatus, comprising:

a flexible frame;

a tensioned fabric having a perimeter hem, said tensioned fabric comprising a sheet of substantially non-stretchable, flexible fabric material, wherein said tensioned fabric is screen-printable for screen printing display information; and at least one concealable slit formed from said tensioned fabric, wherein said tensioned fabric is maintained by said flexible frame and integrated with said perimeter hem in order for said tensioned fabric to expand with said flexible frame to produce a display area and reduce with said flexible frame for ease of transport, wherein said flexible frame and said tensioned fabric provide a portable display apparatus for use in a trade show, wherein said portable display apparatus is collapsible and self-supporting.

* * * * *